United States Patent [19]

LeBlanc et al.

[11] Patent Number: 4,793,387

[45] Date of Patent: Dec. 27, 1988

[54] OVERFILL SPILLAGE PROTECTION DEVICE

[75] Inventors: Leo J. LeBlanc, Bloomfield Hills; Elmer P. Klop, Grand Haven, both of Mich.

[73] Assignee: Enterprise Brass Works, Inc., Muskegon, Mich.

[21] Appl. No.: 93,917

[22] Filed: Sep. 8, 1987

[51] Int. Cl.[4] ..... B65B 3/06

[52] U.S. Cl. ..... 141/86; 141/98; 141/311 A; 52/20; 137/312; 404/25; 138/89; 285/226; 220/85 F

[58] Field of Search ..... 141/86, 88, 98, 311 A; 138/121, 28, 89; 4/288; 222/108; 137/312, 313, 314, 356, 363, 364, 365, 369, 370, 371; 52/19, 20, 21; 404/25, 26; 285/226, 57; 277/212; 220/85 F, 85 R, 85 S, 85 P, 281

[56] References Cited

U.S. PATENT DOCUMENTS

| | | | |
|---|---|---|---|
| 1,869,475 | 8/1932 | Hale | 220/85 S |
| 1,974,034 | 9/1934 | Pelleriti | 220/85 S |
| 2,452,615 | 11/1948 | Thomson | 137/369 X |
| 2,565,296 | 8/1951 | Chyle | 138/121 |
| 2,682,893 | 7/1954 | Ziebold | 138/30 |
| 2,741,301 | 4/1956 | Lines | 239/126 |
| 3,001,801 | 9/1961 | Downing | 285/13 |
| 3,355,190 | 11/1967 | Francis | 285/226 X |
| 3,369,829 | 2/1968 | Hopkins | 285/226 X |
| 3,574,354 | 4/1971 | Mischel | 285/226 X |
| 4,059,135 | 11/1977 | Hansel | 141/207 |
| 4,100,629 | 7/1978 | Jones et al. | 138/89 X |
| 4,182,356 | 1/1980 | Woodford, Sr. | 138/28 X |
| 4,191,358 | 3/1980 | Ferri | 251/5 |
| 4,204,564 | 5/1980 | Balfour | 141/311 A |
| 4,214,614 | 7/1980 | Pyle | 141/1 |
| 4,278,115 | 7/1981 | Briles et al. | 141/86 |
| 4,457,349 | 7/1984 | Vazin | 141/86 |
| 4,491,147 | 1/1985 | Argandona | 137/371 |
| 4,520,852 | 6/1985 | Klein | 141/86 |
| 4,526,015 | 7/1985 | Laskaris | 220/85 S X |
| 4,527,708 | 7/1985 | Dundas et al. | 222/18 |
| 4,557,302 | 12/1985 | Sunderhaus | 141/207 |
| 4,593,714 | 6/1986 | Madden | 137/371 |
| 4,615,362 | 10/1986 | Hartman et al. | 141/86 |
| 4,655,361 | 4/1987 | Clover et al. | 220/85 F |
| 4,659,251 | 4/1987 | Petter et al. | 141/86 X |
| 4,696,330 | 9/1987 | Raudman et al. | 141/86 |
| 4,706,718 | 11/1987 | Milo | 141/86 |

FOREIGN PATENT DOCUMENTS

| | | | |
|---|---|---|---|
| 831980 | 9/1938 | France | 285/226 |
| 1101074 | 1/1968 | United Kingdom | 285/226 |
| 0000493 | 8/1979 | World Int. Prop. O. | 404/25 |

*Primary Examiner*—Henry J. Recla
*Assistant Examiner*—Ernest G. Cusick
*Attorney, Agent, or Firm*—Basile and Hanlon

[57] ABSTRACT

An overfill and spillage protection device for capturing fuel spilled from a tank touch supply hose or the fill pipe of an underground fuel storage tank takes the form of a tubular reservoir having an axially flexible bellows shaped side wall. Forces induced by freezing or thawing of the ground in which the reservoir is embedded which would apply strain to the coupling between the reservoir and fill pipe are absorbed by the flexing action of the bellows shaped reservoir. A rigid tubular skirt slidably encloses the bellows portion to prevent concrete or dirt from packing into the concave regions of the bellows.

7 Claims, 1 Drawing Sheet

OVERFILL SPILLAGE PROTECTION DEVICE

BACKGROUND OF THE INVENTION

1. Field of the Invention

The present invention is concerned with overfill and spillage protection devices employed in conjunction with underground fuel storage tanks typically utilized at gasoline service stations. Such tanks are filled from tank trucks through a fill pipe which extends upwardly from the tank to a coupling located within a relatively shallow manhole in the service station apron. During the filling operation, a supply hose from the tank truck is connected to the coupling.

It is quite common that the refilling operation overfills the tank, and when the supply hose is uncoupled from the fill pipe, excess fuel will spill from the fill pipe and uncoupled supply hose. Spillage can also occur from leaky supply hoses or couplings.

2. Description of Prior Art

Because it is obviously undesirable to allow the spillage of fuel to simply drain into the ground, particularly when the storage tank may be refilled on a weekly basis, some states presently require that overfill protection and storage devices be employed on all underground fuel storage tanks. An overfill and spillage protection device for this purpose is shown in U.S. Pat. No. 4,615,362.

In general terms, the overfill and spillage protection device of U.S. Pat. No. 4,615,362 takes the form of a generally cylindrical reservoir sealed at its lower end to the outer side of the storage tank fill pipe and extending upwardly beyond the upper end of the fill pipe in spaced surrounding relationship to the fill pipe so fuel which may spill from the top of the fill pipe or from a supply hose upon uncoupling of the hose from the fill pipe will be captured within the reservoir. Valve means are provided to drain fuel from the reservoir into the storage tank when the level of fuel within the fill pipe is lowered as fuel is withdrawn from the tank during usage.

The overfill reservoir of U.S. Pat. No. 4,615,362 is buried below ground level and is fixedly coupled to the upper end of the fill pipe, whose lower end in turn is fixedly coupled to the underground storage tank. The underground storage tank is massive and invariably buried at a depth well below the frost line. It is thus an immovable object which fixedly and rigidly anchors the fill pipe. The spillage reservoir, on the other hand, is located close to the ground surface with its upper end closed only by a metal cover directly exposed to the outside air temperature. In colder climates, particularly in variable weather conditions, the frost line may extend below the bottom of the overfill reservoir and the earth underlying the reservoir may alternately freeze and thaw over a period of several months. When the earth underlying the spillage reservoir freezes, it expands and can exert a substantial upward pressure against the bottom of the reservoir which places a substantial strain on the coupling and seal between the reservoir and fill pipe. This will ultimately result in leakage at the coupling which is extremely difficult to detect.

The present invention is especially directed to an improved form of overfill and spillage reservoir which is capable of absorbing forces applied to the reservoir by freezing and thawing.

SUMMARY OF THE INVENTION

In accordance with the present invention, an overfill and spillage capturing reservoir includes a hollow tubular member having its outer sidewall at least partially formed in a bellows shape configuration. This tubular member is constructed from a fuel impervious material having sufficient flexibility so that the member can be axially compressed or extended over a reasonable range of movement.

The upper end of the tubular member is formed with a flange by means of which the upper end of the member may be fixedly and sealingly attached to an annular metal rim which receives a removable manhole type cover.

The lower end of the tubular member is formed with a central opening within which is fixedly and sealingly mounted a hollow tubular coupling member which projects downwardly from the bottom of the tubular member and upwardly into its interior. The coupling member is threaded at its lower end to sealingly mount the reservoir upon the upper end of an underground storage tank fill pipe, while the upper end of the coupling may be threaded to receive a hose coupling to be supported within the interior of the reservior or alternatively, the upper end of the coupling may be formed as a supply hose coupling. A valve controlled drain passage extends through the coupling member of the reservoir to accommodate drainage of the reservoir into the central passage through the coupling and an electrical conductor is electrically connected between the upper rim and the coupling member of the reservoir to electrically ground these two metal elements to each other and to the attached fill pipe.

Other objects and features of the invention will become apparent by reference to the following specification and to the drawings.

IN THE DRAWINGS

FIG. 1 is a perspective view of an overfill and spillage protection device embodying the present invention showing the device in place with portions of the surrounding earth and concrete apron broken away; and FIG. 2 is a cross-sectional view taken on a vertical axially extending plane of the device of FIG. 1.

DESCRIPTION OF PREFERRED EMBODIMENT

Figure 1:
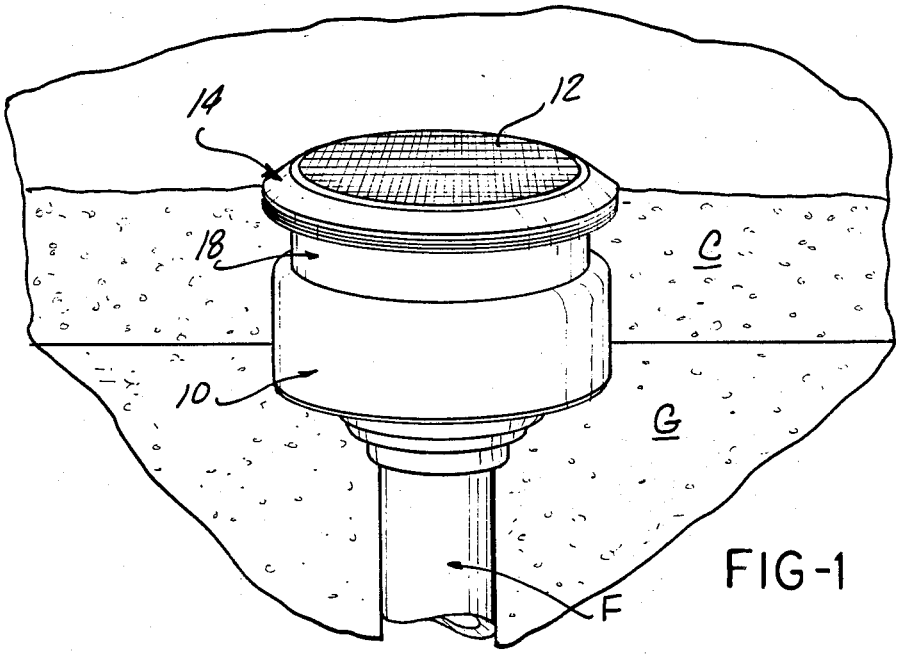

In FIG. 1, an overfill storage and protection device embodying the present invention is designated generally 10 and is shown in a typical installed position with the device embedded in a concrete apron C of a service station and projecting downwardly below the apron into the ground G upon which the apron rests. A fill pipe F is fixedly and sealingly secured at its upper end to the lower end of device 10 and extends vertically downwardly from device 10 to an underground fuel storage tank, not shown. Device 10 includes a removable manhole type cover 12 which, when in place, lies substantially flush with the surface of the concrete apron C.

Figure 2:
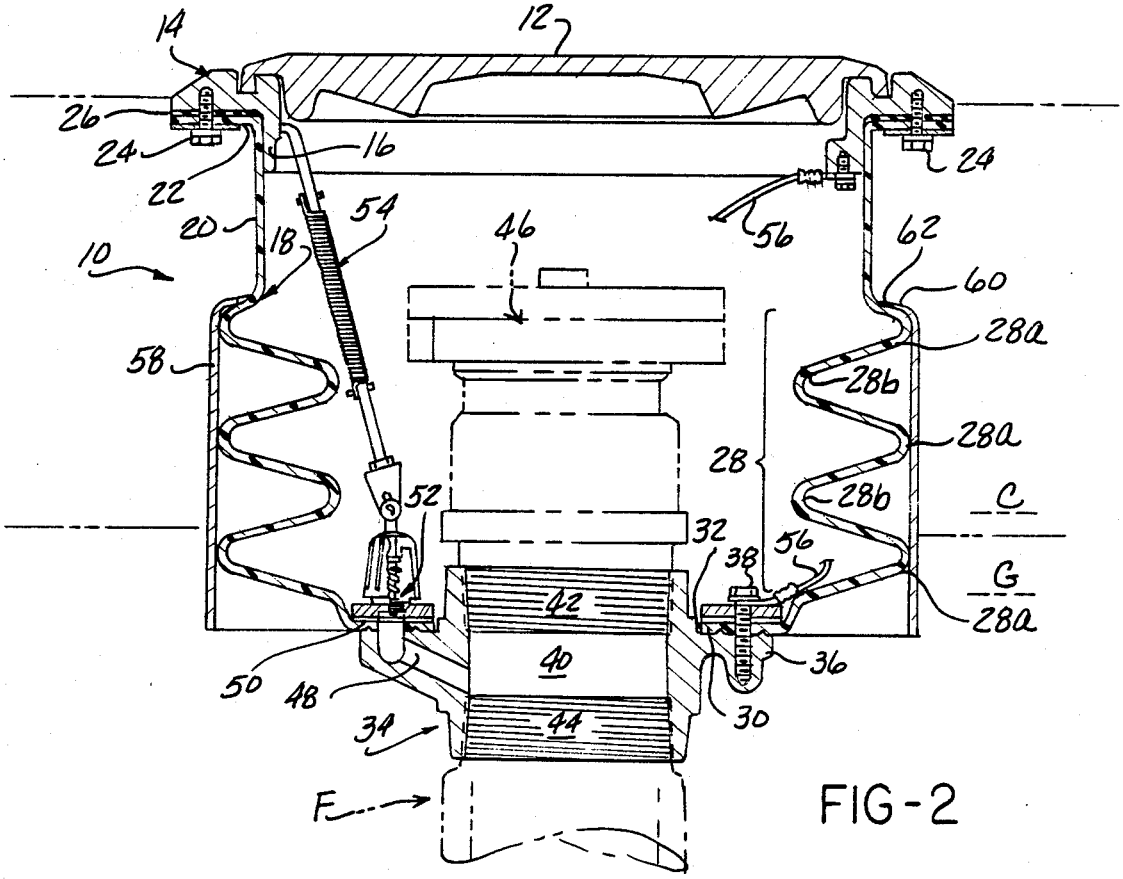

Referring now to FIG. 2, it is seen that device 10 includes an annular upper rim designated generally 14 formed with a downwardly projecting extension 16 of reduced diameter dimensioned to slidably receive the upper end of a hollow tubular member designated generally 18.

Tubular member 18 is formed with a radially outwardly projecting annular flange 22 at its upper end which is fixedly and sealingly secured to rim 14 as by bolts 24 and a sealing gasket 26. Cylindrical section 20 of tubular member 18 extends downwardly from flange 22 to merge at its lower end with a bellows shaped section 28 of alternate radially outwardly convex **28*a* and concave 28*b* annular sections. Tubular member 18 is constructed of a material which is impervious to the fuel which will be handled by the device and which possesses sufficient flexibility so that the bellows shaped portion of member 18 accommodates a reasonable amount of axial compression and extension of member 18**. A preferred material for this purposes is a cross-linked polyethylene.

At its lower end, tubular member 18 is formed with a radially inwardly projecting flange 30 which terminates at its radially inner end at a centrally located circular opening 32. A tubular coupling member designated generally 34 is received within opening 32 and formed with a radially outwardly projecting annular flange 36 which is fixedly and sealing clamped to flange 30 of the tubular member 18 as by bolts 38.

Coupling member 34 is formed with a central through passage 40 which is internally threaded at its upper and lower ends as at 42, 44. Threads 44 at the lower end of coupling member 34 are employed to couple reservoir 10 to the upper end of fill pipe F, while the threads 42 at the upper end of the coupling member may be employed to mount a supply hose receiving coupling designated generally 46. Alternatively, coupling 46 may be formed integrally with coupling 34. A valve controlled drain passage 48 extends from the middle portion of passage 40 of coupling 34 through the coupling 34 and flange 30 of the tubular member to open into the interior of the tubular member 18 through a valve seat 50. Valve seat 50 is normally closed by a spring loaded valve designated generally 52 which may be manually opened by pulling upwardly on a valve actuating handle 54 to drain fuel from the interior or tubular member 18 into passage 40. Because tubular member 18 is electriclaly non-conductive, an electrical conductor or ground wire, whose opposite ends are indicated at 56, is electrically connected between coupling 34 and the metallic upper rim 14 to assure that the rim is adequately electrically grounded.

A rigid hollow tubular skirt 58 is mounted at the exterior of member 18 to enclose the bellows section 28 of member 18. Skirt 58 is formed with a radially inwardly projecting lip 60 at its upper end which overlies and rests upon the radially outwardly flared surface 62 which forms the upper surface of the uppermost radially outwardly convex portion **28*a* of bellows section 28. The inner wall of skirt 58 slidably engages the peaks of the outwardly convex portions 28*a* of the bellows. The skirt functions to prevent dirt or concrete from filling the outwardly concave portions 28*b* of bellows section 28**, which would interfere with the flexing action of the bellows.

When installed at the service station, the upper end of the device is embedded as shown in the concrete apron and is thus in effect fixedly coupled to the apron. The lower end of tubular member 18 is fixedly coupled to the upper end of the fill pipe which is in turn fixedly anchored by the underground storage tank to which it is connected. Upward forces exerted by freezing of the ground below apron C or the lower end of tubular member 18 are absorbed by the flexing action of bellows section 28 so that forces tending to vertically separate coupling 34 from fill pipe F are minimized.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

We claim:

1. An overfill and spillage protection device for use in combination with an underground fuel storage tank having fill pipe means extending upwardly from said tank to an upper end located below ground level, said device comprising a hollow, tubular, bellows member symmetrical about a central vertical axis; said tubular bellows member being of a fuel impervious material of sufficient flexibility to accommodate axial extension and compression of said tubular bellows member, said member having an upper end, a lower end, an exterior surface and an internal chamber, means defining a relatively short, hollow, cylindrical section of said member extending downwardly from said upper end to a radially outwardly flared annular projection, said annular projection constituting the uppermost portion of a hollow bellows-shaped section of said tubular bellows member integral with and extending downwardly from said cylindrical section substantially to said lower end, a rigid annular rim member fixedly and sealingly secured to the upper end of said tubular bellows member in coaxial relationship to said central vertical axis, annular fill pipe coupling means fixedly and sealingly secured to said lower end in coaxial relationship to said central vertical axis, and a rigid, hollow, cylindrical skirt surrounding the exterior surface of said bellows-shaped section of said tubular member in axially overlapping relationship therewith, said rim member being adapted to be fixedly embedded in the ground at ground level and said coupling means being adapted to be fixedly and sealingly coupled to said upper end of said fill pipe means.

2. The invention defined in claim 1 wherein said bellows-shaped section of said tubular bellows member further comprises an annular lower flange means at the lower end of said bellows-shaped section projecting radially inwardly to define a central circular opening through said lower end of said tubular bellows member, and a radially outwardly projecting annular flange on said coupling means fixedly and sealingly secured to said lower flange means to locate said coupling means within said opening.

3. The invention defined in claim 2 wherein said coupling means comprises means defining a central through passage extending axially through said coupling means, and means at the lower end of said passage for fixedly and sealingly mounting said coupling means upon the upper end of the fill pipe means.

4. The invention defined in claim 3 further comprising means defining a drain passage through said coupling means placing the lower end of the interior of said tubular bellows member in communication with said central passage.

5. The invention defined in claim 2 wherein said cylindrical skirt includes an annular radially inwardly projecting lip at its upper end adapted to rest upon the radially outwardy flared annular projection which constitutes the upper surface of the uppermost radially outwardly convex portion of said bellows-shaped section of said tubular bellows member.

6. The invention defined in claim 1 wherein said tubular bellows member is formed of a polyethylene material and said rim member and said coupling means are metal, and said device further comprises an electrical conductor within said tubular bellows member electrically connecting said rim member to said coupling means.

7. The invention defined in claim 1 wherein the interior surface of said skirt is a smooth cylindrical surface slideably engaged with the radially outermost portions of said bellows-shaped section of said tubular bellows member.

* * * * *